US010718040B2

(12) United States Patent
Hayashida et al.

(10) Patent No.: US 10,718,040 B2
(45) Date of Patent: Jul. 21, 2020

(54) HOT-ROLLED STEEL SHEET, STEEL MATERIAL, AND METHOD FOR PRODUCING HOT-ROLLED STEEL SHEET

(71) Applicant: NIPPON STEEL & SUMITOMO METAL CORPORATION, Tokyo (JP)

(72) Inventors: Teruki Hayashida, Tokyo (JP); Kazuya Ootsuka, Tokyo (JP); Akifumi Sakakibara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 62 days.

(21) Appl. No.: 15/553,391

(22) PCT Filed: Apr. 21, 2016

(86) PCT No.: PCT/JP2016/062633
§ 371 (c)(1),
(2) Date: Aug. 24, 2017

(87) PCT Pub. No.: WO2016/171212
PCT Pub. Date: Oct. 27, 2016

(65) Prior Publication Data

US 2018/0073115 A1 Mar. 15, 2018

(30) Foreign Application Priority Data

Apr. 22, 2015 (JP) ..... 2015-087958

(51) Int. Cl.

| | |
|---|---|
| ***C21D 9/46*** | (2006.01) |
| ***C22C 38/54*** | (2006.01) |
| ***C22C 38/12*** | (2006.01) |
| ***C22C 38/00*** | (2006.01) |
| ***C21D 8/02*** | (2006.01) |
| ***C22C 38/26*** | (2006.01) |
| ***C21D 6/00*** | (2006.01) |
| ***C22C 38/08*** | (2006.01) |
| ***C22C 38/16*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C22C 38/54* (2013.01); *C21D 6/005* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/26* (2013.01); *C22C 38/42* (2013.01); *C22C 38/44* (2013.01); *C22C 38/46* (2013.01); *C22C 38/48* (2013.01); *C21D 2211/003* (2013.01); *C21D 2211/005* (2013.01); *C21D 2211/009* (2013.01)

(58) Field of Classification Search
CPC ..... C21D 2211/003; C21D 2211/005; C21D 2211/009; C21D 8/0205; C21D 8/0226; C21D 9/46; C22C 38/00
USPC ..... 148/330
See application file for complete search history.

(56) References Cited

U.S. PATENT DOCUMENTS

| | | | | |
|---|---|---|---|---|
| 9,574,254 | B2 * | 2/2017 | Takashima | C23C 2/06 |
| 2014/0299238 | A1 | 10/2014 | Takashima et al. | |

FOREIGN PATENT DOCUMENTS

| | | | |
|---|---|---|---|
| CN | 1183268 | C | 1/2005 |
| CN | 101595234 | A | 12/2009 |
| CN | 103108974 | A | 5/2013 |
| CN | 103842538 | A | 6/2014 |
| EP | 1191114 | A1 | 3/2002 |
| EP | 2762581 | A1 | 8/2014 |
| EP | 2762584 | A1 | 8/2014 |
| JP | 63-145745 | A | 6/1988 |

(Continued)

OTHER PUBLICATIONS

NPL: on-line English translation of JP 2008274332 A, Nov. 2008 (Year: 2008).*

(Continued)

*Primary Examiner* — Jie Yang
(74) *Attorney, Agent, or Firm* — Birch, Stewart, Kolasch & Birch, LLP

(57) ABSTRACT

The present invention provides a hot-rolled steel sheet capable of preventing softening of the strength of a sheet-thickness central portion of the steel sheet in thermal treatment, even in the case where an amount of working performed on the steel sheet is small and a work hardening rate is low.

A hot-rolled steel sheet of the present invention consists of chemical components of, in mass %, C: 0.040 to 0.150%, Si: 0 to 0.500%, Mn: 0.10 to 1.50%, P: 0 to 0.050%, S: 0 to 0.020%, Al: 0.010 to 0.050%, N: 0.0010 to 0.0060%, Nb: 0.008 to 0.035%, Cu: 0 to 0.10%, Ni: 0 to 0.10%, Cr: 0 to 0.02%, Mo: 0 to 0.020%, V: 0 to 0.020%, Ca: 0 to 0.0100%, B: 0 to 0.0050%, and the balance: Fe and impurities. The hot-rolled steel sheet contains 0.005 to 0.030% dissolved Nb. An area fraction of ferrite structure is 85% or more, the balance is cementite and/or pearlite structure, and an average crystal grain size of ferrite is equal to or more than 5 μm and equal to or less than 20 μm.

7 Claims, No Drawings

(56) References Cited

FOREIGN PATENT DOCUMENTS

| | | | | | |
|---|---|---|---|---|---|
| JP | 3-044423 | A | | 2/1991 | |
| JP | 11-236646 | A | | 8/1999 | |
| JP | 2000-328186 | A | | 11/2000 | |
| JP | 2001-164334 | A | | 6/2001 | |
| JP | 2008-214658 | A | | 9/2008 | |
| JP | 2008274332 | A | * | 11/2008 | ..... C21D 8/02 |
| JP | 2009-293067 | A | | 12/2009 | |
| JP | 2012-177176 | A | | 9/2012 | |
| KR | 10-2014-0068218 | A | | 6/2014 | |
| WO | WO 2013/046693 | A1 | | 4/2013 | |

OTHER PUBLICATIONS

Japanese Office Action dated Aug. 14, 2018, issued in Japanese Patent Application No. 2017-514184 (partial English translation).
International Search Report (PCT/ISA/210) issued in PCT/JP2016/062633, dated Aug. 2, 2016.
Office Action issued in Taiwanese Patent Application No. 105112640, dated Nov. 15, 2016.
Written Opinion (PCT/ISA/237) issued in PCT/JP2016/062633, dated Aug. 2, 2016.
Extended European Search Report, dated Aug. 7, 2018, for corresponding European Application No. 16783233.6.
Chinese Office Action and Search Report dated Oct. 24, 2018, for corresponding Chinese Patent Application No. 201680021839.0, with partial English translation of the Office Action.
Korean Office Action dated Oct. 29, 2018, for corresponding Korean Patent Application No. 10-2017-7026049, with partial English translation.

* cited by examiner

HOT-ROLLED STEEL SHEET, STEEL MATERIAL, AND METHOD FOR PRODUCING HOT-ROLLED STEEL SHEET

TECHNICAL FIELD

The present invention relates to a hot-rolled steel sheet, a steel material, and a method for producing a hot-rolled steel sheet.

BACKGROUND ART

Hardening treatment is performed on the surface of a steel sheet in order to improve wear resistance and fatigue strength of steel material parts. A known example of such hardening treatment is thermal treatment in a controlled atmosphere, such as carburizing treatment, nitriding treatment, or softnitriding treatment.

When hardening treatment is performed on the steel sheet surface, the steel sheet surface hardens, whereas heating in the hardening treatment causes crystal grains in a sheet-thickness central portion of the steel sheet to grow and coarsen, softening the hardness (strength) of the sheet-thickness central portion.

A known means for suppressing the growth of crystal grains in the sheet-thickness central portion is to add a small amount of Nb. When Nb is added to steel, niobium carbide (NbC; a precipitate in which Nb and carbon are bound together) is precipitated, and this NbC has a pinning action of suppressing the growth of crystal grains, which is presumed to prevent the growth of crystal grains in the sheet-thickness central portion in thermal treatment (e.g., see Patent Literature 1).

CITATION LIST

Patent Literature

Patent Literature 1: JP H11-236646A

SUMMARY OF INVENTION

Technical Problem

Moreover, when a steel sheet is subjected to cold plastic deformation, the strength of the steel sheet can be increased by work hardening. Hence, cold plastic deformation is performed on a Nb-added steel sheet to cause work hardening, increasing the strength of the steel sheet, and furthermore, hardening treatment is performed on the steel sheet surface. This makes it possible to harden the surface layer while suppressing softening of work hardening of the sheet-thickness central portion.

According to research by the inventors, the following facts have been found. In the case where an amount of working through plastic deformation is large and a work hardening rate is high, softening of the sheet-thickness central portion can be suppressed by performing thermal treatment on the Nb-added steel sheet. In the case where an amount of working is small and a work hardening rate is low, softening of the sheet-thickness central portion cannot be suppressed even if thermal treatment is performed on the Nb-added steel sheet.

For example, when automobile parts are produced, after a steel sheet is subjected to cold working by press forming or the like, the surface is subjected to softnitriding in some cases. Here, since automobile parts have various shapes, when the steel sheet is subjected to press working, an area with a relatively large amount of working and an area with a relatively small amount of working occur in one part. Here, in the case where a Nb-containing steel sheet is used, thermal treatment in softnitriding may soften the strength of the sheet-thickness central portion in an area with a relatively small amount of working, causing insufficiency in the strength of the part.

Hence, in view of such circumstances, an object of the present invention is to provide a hot-rolled steel sheet, a steel material, and a method for producing a hot-rolled steel sheet that are capable of preventing softening of the strength of a sheet-thickness central portion of the steel sheet in thermal treatment, even in the case where an amount of working performed on the steel sheet is small and a work hardening rate is low.

Solution to Problem (1)

A hot-rolled steel sheet consisting of chemical components of, in mass %,

C: 0.040 to 0.150%,
Si: 0 to 0.500%,
Mn: 0.10 to 1.50%,
P: 0 to 0.050%,
S: 0 to 0.020%,
Al: 0.010 to 0.050%,
N: 0.0010 to 0.0060%,
Nb: 0.008 to 0.035%,
Cu: 0 to 0.10%,
Ni: 0 to 0.10%,
Cr: 0 to 0.02%,
Mo: 0 to 0.020%,
V: 0 to 0.020%,
Ca: 0 to 0.0100%,
B: 0 to 0.0050%, and
the balance: Fe and impurities, in which the hot-rolled steel sheet contains 0.005 to 0.030% dissolved Nb, and an area fraction of ferrite structure in a metal structure is 85% or more, the balance of the metal structure is cementite and/or pearlite structure, and an average crystal grain size of ferrite is equal to or more than 5 μm and equal to or less than 20 μm.

(2)

The hot-rolled steel sheet according to (1), in which Vickers hardness of a sheet-thickness central portion when cold working and thermal treatment of heating at 560 to 620° C. for 120 minutes are performed sequentially on the hot-rolled steel sheet exhibits resistance to softening of 80% or more with respect to Vickers hardness of the sheet-thickness central portion after the cold working.

(3)

The hot-rolled steel sheet according to (1), in which Vickers hardness of a sheet-thickness central portion when cold working that makes a work hardening rate of Vickers hardness less than 30% and thermal treatment of heating at 560 to 620° C. for 120 minutes are performed sequentially on the hot-rolled steel sheet exhibits resistance to softening of 80% or more with respect to Vickers hardness of the sheet-thickness central portion after the cold working.

(4)

A steel material including the hot-rolled steel sheet according to any one of (1) to (3), in which Vickers hardness of a sheet-thickness central portion when cold working and thermal treatment of heating at 560 to 620° C. for 120 minutes are performed sequentially on the hot-rolled steel sheet is 80% or more with respect to Vickers hardness of the sheet-thickness central portion after the cold working.

(5)

A steel material including the hot-rolled steel sheet according to any one of (1) to (3), in which Vickers hardness of a sheet-thickness central portion when cold working that makes a work hardening rate of Vickers hardness less than 30% and thermal treatment of heating at 560 to 620° C. for 120 minutes are performed sequentially on the hot-rolled steel sheet is 80% or more with respect to Vickers hardness of the sheet-thickness central portion after the cold working.

(6)

A method for producing a hot-rolled steel sheet, including:

heating a slab to 1200° C. or more;

performing final rolling of finish rolling at a finish rolling temperature of equal to or more than 860° C. and equal to or less than 950° C.;

performing cooling at an average cooling rate of equal to or more than 30° C./sec and equal to or less than 100° C./sec from the finish rolling temperature to 800° C.;

performing cooling at an average cooling rate of equal to or more than 5° C./sec and equal to or less than 100° C./sec from 800° C. to a coiling temperature; and performing coiling at a coiling temperature of equal to or more than 300° C. and equal to or less than 600° C., in which the slab consists of chemical components of, in mass %, C: 0.040 to 0.150%,
Si: 0 to 0.500%,
Mn: 0.10 to 1.50%,
P: 0 to 0.050%,
S: 0 to 0.020%,
Al: 0.010 to 0.050%,
N: 0.0010 to 0.0060%,
Nb: 0.008 to 0.035%,
Cu: 0 to 0.10%,
Ni: 0 to 0.10%,
Cr: 0 to 0.02%,
Mo: 0 to 0.020%,
V: 0 to 0.020%,
Ca: 0 to 0.0100%,
B: 0 to 0.0050%, and
the balance: Fe and impurities.

Advantageous Effects of Invention

According to the present invention, it is possible to provide a hot-rolled steel sheet, a steel material, and a method for producing a hot-rolled steel sheet that are capable of preventing softening of the strength of a sheet-thickness central portion of the steel sheet in thermal treatment, even in the case where an amount of working performed on the steel sheet is small and a work hardening rate is low.

DESCRIPTION OF EMBODIMENTS

First, the principle of the present invention is described below with presumptions, in advance of detailed description of preferred embodiment(s) of the present invention.

When a steel sheet in which NbC exists in the steel structure is subjected to cold working, if cold working is performed under a condition that makes a work hardening rate high, binding between Nb and C of NbC existing in the steel is released by plastic deformation, and dissolved Nb and C are finely dispersed in the steel sheet. Furthermore, when the cold-worked steel sheet is subjected to thermal treatment, dissolved Nb and C are bound together again to form NbC, and a pinning action of this newly formed NbC prevents the growth of crystal grains in the sheet-thickness central portion and suppresses softening in thermal treatment.

In contrast, if cold working is performed under a condition that makes a work hardening rate low, NbC existing in the steel undergoes small deformation; therefore, binding between Nb and C is released for an extremely small amount of NbC, which results in a small amount of dissolved Nb for generating fine NbC by subsequent thermal treatment. Therefore, the effect of delaying dislocation movement by the pinning action of NbC is not exerted significantly; thus, growth of crystal grains is not prevented, which reduces the effect of suppressing recrystallization.

As described above, when a conventional steel sheet containing a large amount of NbC is subjected to cold working under a condition that makes a work hardening rate low, binding between Nb and C is released for a small amount of NbC; hence, most of NbC particles are relatively large particles as formed in hot rolling. When thermal treatment is performed subsequently, a small number of NbC particles are precipitated by the thermal treatment because the amount of dissolved Nb is small, and the effect of the pinning action of newly formed NbC decreases; thus, it is presumed to be impossible to prevent the growth of crystal grains in the sheet-thickness central portion in thermal treatment, and suppress thermal softening of the sheet-thickness central portion in thermal treatment.

On the basis of the above consideration, the present inventors have found that by containing a large amount of dissolved Nb in steel in advance, softening of a sheet-thickness central portion can be prevented even in the case where thermal treatment is performed after plastic working, regardless of a work hardening rate when a steel sheet is subjected to cold plastic working.

The dissolved Nb contained in the steel in advance exists in the steel sheet uniformly; therefore, when dissolved Nb and C are bound together to form NbC in thermal treatment, NbC exists in a state of being finely dispersed in the steel sheet; thus, the pinning action of NbC is presumed to prevent the growth of crystal grains in the sheet-thickness central portion in thermal treatment.

In particular, dissolved Nb has a property of generating a large amount of NbC in the vicinity of a dislocation that has been caused in steel by cold plastic working; therefore, a steel sheet subjected to cold working is advantageous in terms of preventing softening of the strength of a sheet-thickness central portion of the steel sheet in thermal treatment. That is, in the case where a steel sheet in which dissolved Nb exists in steel is subjected to cold working and then to thermal treatment, dissolved Nb and C are combined to form NbC when temperature is raised to 500 to 600° C., which is a softnitriding treatment temperature, for example. However, in the case where a steel sheet in which no dissolved Nb exists but NbC exists in steel is not subjected to cold working and the steel sheet as hot-rolled is subjected to thermal treatment, heating proceeds in a state where not much fine NbC is newly generated; thus, a pinning action is exerted by only a small number of coarse NbC particles generated when the hot-rolled steel sheet is produced. This reduces the effect of delaying dislocation movement at a temperature of 550° C. or more at which recrystallization of crystal grains starts; thus, it is presumed to be impossible to prevent the growth of crystal grains in the sheet-thickness central portion in thermal treatment, and suppress thermal softening of the sheet-thickness central portion in thermal treatment.

To promote generation of NbC, which prevents the growth of crystal grains in the sheet-thickness central portion in thermal treatment, first, it is effective to cause dissolved Nb to remain in the steel. As described above, the present invention has found a method of suppressing thermal softening of the sheet-thickness central portion in thermal treatment by causing dissolved Nb to remain in steel when a hot-rolled steel sheet is produced, instead of suppressing thermal softening of the sheet-thickness central portion in thermal treatment by performing high cold working to make NbC in steel into dissolved Nb. Moreover, the present inventors have found that, in terms of preventing softening of the strength of a sheet-thickness central portion of the steel sheet in thermal treatment, it is effective to forcibly introduce dislocations into steel with remaining dissolved Nb, and generate a large amount of NbC from dissolved Nb in the vicinity of the dislocations in thermal treatment.

The amount of dislocations forcibly introduced to promote generation of NbC can be expressed by an amount of hardening of Vickers hardness due to cold working. In the present invention, hardening is preferably performed in an amount of 10% or more with respect to the Vickers hardness of a material before cold working.

As described above, a hot-rolled steel sheet of the present invention can be used particularly suitably in the case where thermal treatment of surface hardening or the like (e.g., softnitriding treatment) is performed after cold working.

Description will be given on a hot-rolled steel sheet of the present embodiment, a steel material obtained by performing cold working and thermal treatment on the hot-rolled steel sheet, and a method for producing the hot-rolled steel sheet.

First, chemical components of the hot-rolled steel sheet of the present embodiment are described. The content of each component is expressed by mass %. Unless otherwise specified, ranges in this specification include an upper limit value and a lower limit value.

(C: 0.040 to 0.150%)

C is an element effective in keeping strength. An amount of C of 0.040% or more is needed to prevent a decrease in strength of a sheet-thickness central portion by generating a sufficient amount of NbC during thermal treatment (e.g., softnitriding treatment) for a hot-rolled steel sheet that has undergone cold working. On the other hand, if the amount of C is more than 0.150%, press workability of the hot-rolled steel sheet decreases; hence, 0.150% is set as an upper limit. The amount of C is preferably 0.040 to 0.10%, further preferably 0.040 to 0.090%.

(Si: 0 to 0.500%)

Si is an element that deoxidizes and enhances the strength of steel, and is added for strength adjustment in the present embodiment. A large amount of Si causes a surface oxide to be generated on the steel sheet surface during hot rolling, making flaws likely to occur, and also causes a decrease in press workability. Therefore, the amount of Si is set to 0.500% or less. The amount of Si is preferably 0.10% or less, further preferably 0.08% or less. On the other hand, Si is contained in iron ore and thus is normally a component that inevitably exists. Hence, the lower limit value of the amount of Si can also be set to 0.001%. To deoxidize steel and enhance strength of steel, the amount of Si can be set to 0.090% or more, preferably 0.200% or more, for example.

(Mn: 0.10 to 1.50%)

Mn is an element that enhances hardenability of steel and improves strength, and is added for strength adjustment in the present embodiment. If the amount of Mn is less than 0.10%, embrittlement due to S in the steel is likely to occur. If the amount of Mn is more than 1.50%, press formability decreases. The amount of Mn is preferably 0.1 to 1.3%, further preferably 0.1 to 1.10%.

(P: 0 to 0.050%)

P tends to cause embrittlement, and is preferably small in amount to ensure press workability. Hence, an upper limit of the amount of P is set to 0.050%. The amount of P is preferably 0.03% or less, further preferably 0.02% or less. On the other hand, P is contained in iron ore and thus is normally a component that inevitably exists. Hence, the lower limit value of the amount of P can also be set to 0.001%, more specifically 0.002%.

(S: 0 to 0.020%)

Like P, S tends to cause embrittlement, and is preferably small in amount to ensure press workability. Hence, an upper limit of the amount of S is set to 0.020%. The amount of S is preferably 0.015% or less, further preferably 0.010% or less. On the other hand, S is contained in iron ore and thus is normally a component that inevitably exists. Hence, the lower limit value of the amount of S can also be set to 0.001%.

(Al: 0.010 to 0.050%)

Al has an effect of generating a nitride, AlN, on a steel sheet surface in softnitriding treatment to enhance surface hardness. Therefore, an amount of Al of 0.010% or more is needed. On the other hand, to keep high press workability, 0.050% is set as an upper limit. The amount of Al is preferably 0.010 to 0.040%, further preferably 0.015 to 0.030%.

(N: 0.0010 to 0.0060%)

Like Al, N is an element necessary for generating a Al nitride on a steel sheet surface in softnitriding treatment, and is preferably contained in an amount of 0.0010% or more. On the other hand, if a large amount of N exists in the steel sheet before press working, ductility greatly decreases, and workability of the steel sheet decreases. Hence, the amount of N is preferably small, and 0.0060% is set as an upper limit. The amount of N is preferably 0.0010 to 0.0040%, further preferably 0.0010 to 0.0030%.

(Nb: 0.008 to 0.035%)

(Dissolved Nb: 0.005 to 0.030%)

The hot-rolled steel sheet of the present embodiment contains dissolved Nb; thus, when temperature is raised in softnitriding treatment after cold working, dissolved Nb is changed to a precipitate, NbC, with dislocations introduced in cold working serving as starting points, which delays dislocation movement, and makes it possible to keep work hardening that has occurred in cold working. To achieve this, first, 0.005% or more dissolved Nb is needed. An amount of Nb of 0.008% or more is needed for 0.005% or more dissolved Nb. An effect produced by dissolved Nb is saturated at 0.030%; thus, 0.030% is set as an upper limit of dissolved Nb. On the other hand, an increase in Nb in the steel causes a decrease in press workability. Therefore, an upper limit of the amount of Nb is set to 0.035%. The amount of Nb is preferably 0.010 to 0.030%, further preferably 0.010 to 0.025%. The amount of dissolved Nb is preferably 0.005 to 0.030%, further preferably 0.008 to 0.030%.

The amount of Nb dissolved in the steel sheet can be calculated from a residue of electrolytic extraction. For example, a test piece with a size of 30 mm square (30×30 mm=900 $mm^2$) is taken from a position of ¼ or ¾ in sheet width of the steel sheet cooled to room temperature after coiling, and is subjected to constant-current electrolysis in an electrolytic solution, using a 10% acetylacetone-1% tetramethyl ammonium chloride-methanol solution as the electrolytic solution. A residue that remains in the electrolytic solution after constant-current electrolysis is filtered with a 0.2-μm filter and then taken, and the mass of the taken residue is measured. In addition, after the residue is subjected to acid decomposition, the mass of Nb in the residue is measured by inductively coupled plasma atomic emission spectroscopy (ICP-AES). Then, assuming that Nb in this residue existed as a precipitate of carbide or nitride of Nb, the total Nb content of the steel sheet from which the amount of Nb in the residue is subtracted is found as the amount of dissolved Nb.

(Cu: 0 to 0.10%)

Cu is added as necessary for strength adjustment. 0.10% is set as an upper limit to prevent a decrease in workability. To enhance strength without causing a decrease in workability, the amount of Cu is preferably 0.01 to 0.08%, further preferably 0.02 to 0.05%.

(Ni: 0 to 0.10%)

Ni is added to prevent embrittlement cracking during hot rolling when steel containing Cu is produced. The amount of Ni added is preferably about half or more of the amount of Cu. If the amount of Ni is more than 0.10%, workability of the steel sheet decreases; hence, an upper limit is set to 0.10%. To prevent embrittlement cracking without causing a decrease in workability, the amount of Ni is preferably 0.01 to 0.08%, further preferably 0.02 to 0.05%.

(Cr: 0 to 0.02%)

Like Cu, Cr is added as necessary for strength adjustment. 0.02% is set as an upper limit to prevent a decrease in workability. To enhance strength without causing a decrease in workability, the amount of Cr is preferably 0.005 to 0.020%, further preferably 0.010 to 0.015%.

(Mo: 0 to 0.020%)

(V: 0 to 0.020%)

Like Cu, Mo and V are added as necessary for strength adjustment. 0.020% is set as an upper limit of each of them to prevent a decrease in workability. To enhance strength without causing a decrease in workability, the amount of Mo is preferably 0.005 to 0.020%, further preferably 0.010 to 0.018%.

(Ca: 0 to 0.0100%)

Ca is added as necessary to prevent embrittlement due to S and prevent a local ductility decrease due to coarsening of MnS. The effect of Ca is saturated at 0.0100%; thus, this is set as an upper limit. To prevent embrittlement without causing a decrease in workability, the amount of Ca is preferably 0.002 to 0.010%, further preferably 0.002 to 0.008%.

(B: 0 to 0.0050%)

B is added as necessary to prevent aging due to N and prevent a decrease in ductility. At 0.0050%, the effect is saturated, and C is bound to B to cause a decrease in the amount of NbC generated, which reduces resistance to softening in thermal treatment; thus, this is set as an upper limit. To prevent aging due to N without reducing resistance to softening, the amount of B is preferably 0.0003 to 0.0030%, further preferably 0.0004 to 0.0020%.

The balance of the hot-rolled steel sheet is Fe and impurities. The hot-rolled steel sheet contains Fe in an amount of, for example, 97.40 to 99.84%, preferably 98.10 to 99.83%.

Next, the metal structure of a hot-rolled steel sheet is described.

The metal structure of a hot-rolled steel sheet of the present embodiment contains, in area fraction, 85% or more ferrite structure, and the balance is cementite and/or pearlite structure. The average crystal grain size of ferrite is in the range of equal to or more than 5 μm and equal to or less than 20 μm.

If the area fraction of the ferrite structure is less than 85%, workability of the steel sheet decreases, which is not preferable. The area fraction of ferrite is preferably 90% or more, further preferably 92% or more. The balance structure is either one or both of cementite structure and pearlite structure. It is desirable that the structure not contain bainite. The area fraction of a portion that looks white when the steel sheet surface is corroded with nital and observed is found as the area fraction of ferrite. The area fraction of a portion that looks black when the steel sheet surface is corroded with nital and observed is found as the area fraction of the balance structure.

The average crystal grain size of ferrite is preferably equal to or more than 5 μm and equal to or less than 20 μm. If the average crystal grain size is less than 5 μm, the strength of the steel sheet becomes excessively high, elongation EL (%) becomes small, and workability decreases. If the average crystal grain size is more than 20 μm, the surface of the press-worked steel sheet becomes an orange peel surface, and surface roughness increases. The average crystal grain size of ferrite is preferably equal to or more than 6 μm and equal to or less than 15 μm, further preferably equal to or more than 8 μm and equal to or less than 15 μm.

The sheet thickness of the hot-rolled steel sheet of the present embodiment is not particularly limited, but is preferably equal to or more than 2.0 mm and equal to or less than 9.0 mm. In a steel sheet with a thickness of less than 2.0 mm, a hardened layer may be formed up to a sheet-thickness central portion of the steel sheet in softnitriding treatment, which may eliminate the need of an effect of the present invention of improving resistance to softening in thermal treatment. In addition, purposes of the hot-rolled steel sheet of the present embodiment do not assume use of a steel sheet with a thickness of more than 9.0 mm; thus, 9.0 mm can be set as the upper limit of the sheet thickness.

The tensile strength TS of the hot-rolled steel sheet of the present embodiment is equal to or more than 400 MPa and equal to or less than 640 MPa. The elongation EL (%) is 25.0% or more. The tensile strength TS (MPa) and elongation EL (%) are based on "Metallic materials-Tensile testing" of JIS Z 2241 (2011).

In regard to anisotropy in working of the steel sheet, an earing height when the steel sheet is subjected to cylindrical deep drawing is preferably 2 mm or less. When a steel sheet cut out in a circular shape with a diameter of 200 mm and a sheet thickness of 4.5 mm is subjected to cylindrical deep drawing under conditions of a punch inner diameter of 100 mm, a punch shoulder radius of 3 mm, and a clearance of 1.4 times the sheet thickness of the steel sheet, a difference between the maximum height and the minimum height of a cylindrical portion after deep drawing is found as the earing height. To make the earing height 2 mm or less, it is desirable that a finish rolling temperature be set within a range of 900 to 950° C.

Next, a method for producing the hot-rolled steel sheet of the present embodiment is described.

The hot-rolled steel sheet of the present embodiment is produced in the following manner: A slab containing chemical components described above is heated to 1200° C. or more, subjected to the final rolling of finish rolling at a finish rolling temperature of equal to or more than 860° C. and equal to or less than 950° C., cooled at an average cooling rate of equal to or more than 30° C./sec and equal to or less than 100° C./sec from the finish rolling temperature to 800° C., cooled at an average cooling rate of equal to or more than 5° C./sec and equal to or less than 100° C./sec from 800° C. to a coiling temperature, and coiled at a coiling temperature of equal to or more than 300° C. and equal to or less than 600° C.

The heating temperature of the slab may be any temperature equal to or more than 1200° C., but is preferably equal to or more than 1200° C. and equal to or less than 1300° C., further preferably equal to or more than 1220° C. and equal to or less than 1280° C. The heating temperature here is the temperature of a sheet-thickness central portion of the slab. Since Nb exists as a compound, such as NbC, in the slab after casting, heating at 1200° C. or more is performed up to the center of the slab to dissolve Nb in the steel. On the other hand, if the heating temperature is too high, a scale occurs excessively on the slab surface during heating, and flaws may occur on the steel sheet surface after hot rolling. In addition, yield may decrease. Hence, an upper limit of the heating temperature is set to 1300° C.

The finish rolling temperature in the final rolling of finish rolling is set to equal to or more than 860° C. and equal to or less than 950° C. The finish rolling temperature is the actually measured temperature of the steel sheet surface. The finish rolling temperature needs to be 860° C. or more in order that Nb dissolved by heating is not precipitated as carbide. To exert isotropy in press working of the hot-rolled steel sheet, it is desirable that the finish rolling temperature be set to 900° C. or more.

On the other hand, if the finish rolling temperature is too high, crystal grains grow too much, leading to significant anisotropy when the hot-rolled steel sheet is subjected to press working; hence, the upper limit needs to be 950° C. or less. The finish rolling temperature in the final rolling of finish rolling may be any temperature within the range mentioned above, but is preferably equal to or more than 900° C. and equal to or less than 940° C., further preferably equal to or more than 900° C. and equal to or less than 930° C.

The average cooling rate from the finish rolling temperature to 800° C. is set to equal to or more than 30° C./sec and equal to or less than 100° C./sec. The average cooling rate is the average cooling rate in the sheet-thickness central portion of the steel sheet. A temperature range from the finish rolling temperature to 800° C. is a temperature range in which dissolved Nb is likely to be precipitated as NbC; hence, the average cooling rate from the finish rolling temperature to 800° C. is specified so that this temperature range is passed as fast as possible. When the average cooling rate in this temperature range is 30° C./sec or more, precipitated Nb decreases and dissolved Nb increases relatively. On the other hand, if the average cooling rate is too high, the average crystal grain size of ferrite structure becomes too small, or the area fraction of ferrite decreases; hence, 100° C./sec is set as an upper limit. The average cooling rate from the finish rolling temperature to 800° C. may be any temperature within the range mentioned above, but is preferably equal to or more than 40° C./sec and equal to or less than 100° C./sec, further preferably equal to or more than 50° C./sec and equal to or less than 100° C./sec.

The average cooling rate from 800° C. to the coiling temperature is set to equal to or more than 5° C./sec and equal to or less than 100° C./sec. The average cooling rate is the average cooling rate in the sheet-thickness central portion of the steel sheet. A temperature range from 800° C. to the coiling temperature is a temperature range in which dissolved Nb exists stably; hence, in this temperature range, the cooling rate may be eased as compared with the temperature range to 800° C. Hence, the average cooling rate in this temperature range is set within the above range. When the average cooling rate is 5° C./sec or more, the steel sheet temperature can be reduced to an upper limit of the coiling temperature by the coiling of the steel sheet. On the other hand, if the average cooling rate is too high, the area fraction of ferrite decreases and ductility decreases; hence, 100° C./sec is set as an upper limit. The average cooling rate from 800° C. to the coiling temperature may be any temperature within the range mentioned above, but is preferably equal to or more than 15° C./sec and equal to or less than 100° C./sec, further preferably equal to or more than 15° C./sec and equal to or less than 60° C./sec.

The coiling temperature of the cooled steel sheet is set to equal to or more than 300° C. and equal to or less than 600° C. The coiling temperature is the surface temperature of the steel sheet. If the hot-rolled steel sheet of the present embodiment is coiled at low temperature, precipitation of NbC is suppressed and Nb remains dissolved; thus, workability decreases but resistance to softening in thermal treatment is improved. On the other hand, if the hot-rolled steel sheet is coiled at high temperature, elongation of the hot-rolled steel sheet is improved and workability is improved, but a smaller amount of dissolved Nb remains; hence, an upper limit is 600° C. For these reasons, the coiling temperature is limited within the above range in the present embodiment. The coiling temperature of the steel sheet may be any temperature within the range mentioned above, but is preferably equal to or more than 400° C. and equal to or less than 600° C., further preferably equal to or more than 450° C. and equal to or less than 580° C.

The hot-rolled steel sheet of the present embodiment can be produced in the manner described above.

The hot-rolled steel sheet of the present embodiment is formed into a predetermined part shape by cold working such as press forming, and then subjected to surface hardening treatment, such as carburizing treatment, nitriding treatment, nitrocarburizing treatment, or softnitriding treatment to be a steel material for an automobile part or the like. Surface hardening treatment is to perform thermal treatment on a cold-worked hot-rolled steel sheet in a predetermined atmosphere. The hot-rolled steel sheet of the present embodiment has a characteristic of exhibiting a small amount of decrease in Vickers hardness of a sheet-thickness central portion through thermal treatment and being less likely to soften, even when subjected to thermal treatment after cold working.

Cold working may be cold plastic working, such as press working, bore expanding, and bending. In the case where the degree of an amount of working in cold working is expressed by a work hardening rate ΔR (%), cold working with any work hardening rate ΔR (%) may be applied in the present embodiment; when ΔR (%) is 10% or more, dislocations for precipitation of NbC are sufficiently introduced and the effect of resistance to softening is easily exerted. Note that in the present embodiment, a high work hardening rate refers to ΔR (%) of 30% or more. A low work hardening rate refers to ΔR (%) of less than 30%. The hot-rolled steel sheet of the present embodiment exhibits a characteristic of being less likely to soften through thermal treatment even in the case where ΔR (%) is 10 to less than 30%.

The atmosphere in the surface hardening treatment is not particularly limited. As an example, an atmosphere with an $NH_3$ concentration of 35%, a $CO_2$ concentration of 5%, and an $N_2$ concentration of 60% can be given. The hot-rolled steel sheet of the present invention exhibits sufficient resistance to softening even if subjected to thermal treatment with a thermal treatment temperature in the range of 560 to 620° C. and a thermal treatment time of 120 minutes. Note that a temperature range applied in actual surface hardening treatment is a range of 500 to 600° C., and thermal treatment time is about 60 to 180 minutes. Even under these conditions, the hot-rolled steel sheet of the present embodiment exhibits sufficient resistance to softening.

In the hot-rolled steel sheet of the present embodiment, Vickers hardness of a sheet-thickness central portion when cold working and thermal treatment of heating at 560 to 620° C. for 120 minutes are performed sequentially exhibits resistance to softening of 80% or more with respect to Vickers hardness of the sheet-thickness central portion after cold working. In particular, even in the case where cold working that makes a work hardening rate of Vickers hardness less than 30% is performed, Vickers hardness of the sheet-thickness central portion after thermal treatment exhibits resistance to softening of 80% or more with respect to Vickers hardness of the sheet-thickness central portion after cold working.

The work hardening rate in the present embodiment is described below.

Assuming that Vickers hardness of the sheet-thickness central portion before cold working of the hot-rolled steel sheet is Hv (before cold working) and Vickers hardness of the sheet-thickness central portion after cold working is Hv (after cold working), an amount of work hardening ΔWHv is expressed by the following formula (α), and a work hardening rate ΔR (%) is expressed by the following formula (β).

$$\Delta WHv = Hv\ (\text{after cold working}) - Hv\ (\text{before cold working}) \quad (\alpha)$$

$$\Delta R\ (\%) = \Delta WHv / Hv\ (\text{before cold working}) \times 100 \quad (\beta)$$

A rate of change in hardness after thermal treatment is as follows. As thermal treatment, heating for 120 minutes is performed at each thermal treatment temperature. The hot-rolled steel sheet of the present embodiment exhibits ΔHv (%) of 80% or more.

Assuming that Vickers hardness of the sheet-thickness central portion after thermal treatment of the hot-rolled steel sheet that has undergone cold working is Hv (after thermal treatment), an amount of hardening ΔTHv after thermal treatment is expressed by the following formula (γ), and a rate of change in hardness ΔHv (%) after thermal treatment is expressed by the following formula (δ).

$$\Delta THv = Hv\ (\text{after thermal treatment}) - Hv\ (\text{before cold working}) \quad (\gamma)$$

$$\Delta Hv\ (\%) = \Delta THv / \Delta WHv \times 100 \quad (\delta)$$

An upper limit of ΔHv (%) is not 100%, a case where the steel sheet is further hardened by thermal treatment is included. For example, dissolved C in the steel may form NbC by thermal treatment, which may enhance strength.

Vickers hardness of the sheet-thickness center of the hot-rolled steel sheet is hardness measured with a 100 g (0.9807N) weight using a micro Vickers hardness meter in "Vickers hardness test-Test method" specified in JIS Z 2244 (2009). In measurement, a hardness test is performed three times or more in a region of a range of ±100 μm in the sheet-thickness direction at the sheet-thickness center of the hot-rolled steel sheet, and an average value is found.

A steel material produced by performing cold working and surface hardening treatment on the hot-rolled steel sheet exhibits a rate of change in hardness ΔHv (%) after thermal treatment of 80% or more.

As described above, according to the hot-rolled steel sheet of the present embodiment, it is possible to prevent softening of the strength of a sheet-thickness central portion of the steel sheet in thermal treatment, even in the case where an amount of working performed on the steel sheet is small and a work hardening rate is low.

In addition, according to the method for producing a hot-rolled steel sheet of the present embodiment, a hot-rolled steel sheet excellent in resistance to softening in thermal treatment can be produced.

EXAMPLES

Next, the present invention is described in more detail using Examples. Note that Examples below are merely examples of the present invention, and the present invention is not limited to the examples below.

Steel was smelted with a converter, and slabs were produced by continuous casting. Tables 1A and 1B show components 1 to 42 as chemical components of the slabs.

The obtained slab was heated to a predetermined heating temperature, subjected to the final rolling of finish rolling at a predetermined finish rolling temperature, cooled with an average cooling rate from the finish rolling temperature to 800° C. and an average cooling rate from 800° C. to a coiling temperature varied, and coiled at a predetermined coiling temperature; thus, hot-rolled steel sheets of S01 to S84 were produced. Tables 2A to 2C show heating temperatures, finish rolling temperatures, average cooling rates, and coiling temperatures when the hot-rolled steel sheets were produced. Tables 2A to 2C also show sheet thicknesses of the obtained hot-rolled steel sheets. Note that in Tables 2A to 2C, the average cooling rate from the finish rolling temperature to 800° C. is referred to as an average cooling rate I, and the average cooling rate from 800° C. to the coiling temperature is referred to as an average cooling rate II.

Next, the obtained hot-rolled steel sheet was subjected to press working: thus, a press-formed product was produced. The hot-rolled steel sheet cut out in a circular shape with a diameter of 200 mm and a sheet thickness of 4.5 mm was subjected to press working under conditions of a punch inner diameter of 100 mm, a punch shoulder radius of 3 mm, and a clearance of 1.4 times the sheet thickness. By cylindrical deep drawing under these conditions, a cup-like press-formed product with a height of 52 mm was produced. In addition, to check the influence of a change in sheet thickness, hot-rolled steel sheets with sheet thicknesses of 2.0 mm to 9.0 mm were also subjected to similar press working.

Next, softnitriding treatment was performed on the press-formed product. An atmosphere with an $NH_3$ concentration of 35%, a $CO_2$ concentration of 5%, and an $N_2$ concentration of 60% was used as the atmosphere of the softnitriding treatment. A temperature-rise rate was set to 0.7° C./min, a thermal treatment temperature was set to 570 to 625° C., thermal treatment time was set to 120 minutes, and air cooling was performed after heating. Tables 3A to 3C show thermal treatment temperatures of the softnitriding treatment.

(Microstructure of Hot-Rolled Steel Sheet)

In regard to the obtained hot-rolled steel sheet, a cross-section was subjected to nital etching treatment and observed with a microscope; thus, a structure form, the area fraction of ferrite structure, and the average crystal grain size of ferrite were found. Results are shown in Tables 2A to 2C.

(Amount of Dissolved Nb of Hot-Rolled Steel Sheet)

In addition, an amount of dissolved Nb in the hot-rolled steel sheet was measured by the following method. First, a test piece with a size of 30 mm square (30×30 mm=900 $mm^2$) was taken from a position of ¼ in sheet width of the hot-rolled steel sheet cooled to room temperature after coiling. Then, a 10% acetylacetone-1% tetramethyl ammonium chloride-methanol solution was prepared as an electrolytic solution, and the test piece was subjected to constant-current electrolysis in the electrolytic solution. A residue remaining in the electrolytic solution after constant-current electrolysis was filtered with a 0.2-μm filter and then taken, and the mass of the taken residue was measured. In addition, after the residue was subjected to acid decomposition, the mass of Nb in the residue was measured by inductively coupled plasma atomic emission spectroscopy (ICP-AES). Assuming that Nb in the residue had existed as a precipitate of carbide or nitride of Nb, the total Nb content of the steel sheet from which the amount of Nb in the residue was subtracted was found as the amount of dissolved Nb. Results are shown in Tables 2A to 2C.

(Tensile Strength and Elongation)

Moreover, the tensile strength TS and elongation EL (%) of the obtained hot-rolled steel sheet were found. The tensile strength TS (MPa) and elongation EL (%) were measured on the basis of "Metallic materials-Tensile testing" of JIS Z 2241 (2011). Results are shown in Tables 2A to 2C. TS of 400 to 640 MPa was determined to be favorable, and EL of 25.0% or more was determined to be favorable.

(Occurrence/No Occurrence of Press Cracking of Press-Formed Product)

In regard to the press-formed product before softnitriding treatment, occurrence/no occurrence of cracking was evaluated as press cracking evaluation. Evaluation results are shown by "E", "S", "E, S", and "N". Details of "E" to "N" are as follows. Results are shown in Tables 3A to 3C.

E: Cracking has occurred in an end portion of the formed product.

S: There is a crack in a shoulder radius portion.

E, S: Cracking has occurred in an end portion of the formed product, and there is a crack in a shoulder radius portion.

N: No cracking.

(Occurrence/No Occurrence of Press Earing)

In regard to the press-formed product before softnitriding treatment, occurrence/no occurrence of earing was evaluated. A difference between the maximum height and the minimum height of the press-formed product was found as an earing height. Evaluation results are shown by "A", "B", "C", and "D". Details of "A" to "D" are as follows. B and A were determined to be favorable. Note that measurement of press earing was not performed for those in which press cracking has occurred. Results are shown in Tables 3A to 3C.

A: An earing height of equal to or more than 0 mm and equal to or less than 1 mm.

B: An earing height of more than 1 mm and equal to or less than 2 mm.

C: An earing height of more than 2 mm and equal to or less than 3 mm.

D: An earing height of more than 3 mm.

(Occurrence/No Occurrence of Rough Surface)

In regard to the softnitrided press-formed product, a side surface of the formed product was rubbed in the circumferential direction on a grindstone #400; thus, a streak-like flaw was created. On this occasion, a case where the streak-like flaw was formed in a straight line was determined to be favorable and was called (A) with no occurrence of rough surface (an orange peel surface). A case where the streak-like flaw exhibited light and shade or was divided was called (B) with occurrence of rough surface (an orange peel surface). Results are shown in Tables 3A to 3C.

(Hardness Before and after Cold Working)

Vickers hardness of the sheet-thickness central portion of the hot-rolled steel sheet before and after press working was measured. Vickers hardness of the sheet-thickness center in a side-surface portion of the cup-like press-formed product was found as Vickers hardness of the sheet-thickness central portion after press working. The work hardening rate of the press-formed product differs between measurement positions. To research Vickers hardness before and after thermal treatment in a place where the work hardening rate is less than 30%, measurement was performed at positions of 3 to 7 mm from the bottom surface of the press-formed product, and to research Vickers hardness before and after thermal treatment in a place where the work hardening rate is 30% or more, measurement was performed at positions of 25 mm and 35 mm from the bottom surface of the press-formed product. Tables 3A to 3C show Vickers hardness of the sheet-thickness central portion before and after cold working, Hv (before cold working) and Hv (after cold working). In addition, Tables 3A to 3C show a measurement position of Vickers hardness after cold working, Hv (after cold working), and also show a work hardening rate ΔR (%). The work hardening rate ΔR (%) was found on the basis of the above formulas (α) and (β). Note that hardness measurement was not performed for those in which press cracking has occurred.

(Hardness Before and after Thermal Treatment)

Vickers hardness of the sheet-thickness central portion of the hot-rolled steel sheet before and after thermal treatment was measured, and an amount of work hardening ΔTHv through thermal treatment and a rate of change in hardness ΔHv through thermal treatment were found. The amount of work hardening ΔTHv and the rate of change in hardness ΔHv through thermal treatment were found on the basis of the above formulas (γ) and (δ).

A case where ΔHv was 80% or more was called A, and a case where ΔHv was less than 80% was called B. Note that hardness measurement was not performed for those in which press cracking has occurred. Results are shown in Tables 3A to 3C.

The above results are shown in Tables 2A to 2C and Tables 3A to 3C.

Steels S01 to S42, S70, S72, and S73 are hot-rolled steel sheets that were produced using slabs containing chemical components of the present invention, under production conditions specified in the present invention. They exhibit a rate of change in hardness after thermal treatment of 80% or more, which indicates excellent resistance to softening after thermal treatment.

S79 and S80 are hot-rolled steel sheets that were produced using slabs containing chemical components of the present invention, under production conditions specified in the present invention. Specifically, S79 and S03 are examples obtained by hot-rolling the same steel type under the same conditions, and similarly, S80 and S18 are examples obtained by hot-rolling the same steel type under the same conditions. For S79 and S80, the heating temperature in softnitriding was high as compared with S03 and S18, and thus the rate of change in hardness after thermal treatment was less than 80%. However, by setting the heating temperature in softnitriding for these steels S79 and S80 to 620°

C. or less, the rate of change in hardness after thermal treatment becomes 80% or more as in S18 and S03.

Steels S43 to S54 are examples that fall outside chemical components of the present invention.

That is, steel S43 had a small C content, and thus a small amount of NbC was generated during softnitriding treatment, and hardness was not ensured. Moreover, crystal grains of ferrite became coarse and rough surface occurred. Steel S44 had an excessive C content, which lead to a decrease in EL and caused press cracking. Steel S45 had an excessive Si content, which lead to a decrease in EL and caused press cracking. Steel S46 had a small Mn content, and crystal grains of ferrite became coarse and rough surface occurred. Steel S47 had an excessive amount of Mn, and the area fraction of ferrite decreased and bainite was generated, which lead to a decrease in EL and caused press cracking. Steel S48 had an excessive amount of P, and the area fraction of ferrite decreased and bainite was generated, which lead to a decrease in EL and caused press cracking. Steel S49 had an excessive amount of S, which lead to a decrease in EL and caused press cracking. Steel S50 had a small Al content, and crystal grains of ferrite became coarse and rough surface occurred. Steel S51 had an excessive amount of Al, which lead to a decrease in EL and caused press cracking. Steel S52 had an excessive amount of N, which lead to a decrease in EL and caused press cracking. Steel S53 had a small Nb content, which lead to a decrease in dissolved Nb, and thus hardness after softnitriding was not ensured. Steel S54 had an excessive amount of Nb, and the area fraction of ferrite decreased and bainite was generated, which lead to a decrease in EL and caused press cracking.

For steel S55, the heating temperature in hot rolling was low, which lead to a decrease in dissolved Nb, and thus hardness after softnitriding was not ensured.

For steel S56, the cooling rate to 800° C. was high, and thus the area fraction of ferrite decreased, which lead to a decrease in EL and caused press cracking.

For steel S57, B exceeded the upper limit, and earing of the pressed product became large. Furthermore, C was bound to B to cause a decrease in the amount of NbC generated, and thus hardness after softnitriding was not ensured.

For steel S58, the cooling rate from the end of finish rolling until coiling was high; thus, the coiling temperature was low, and the area fraction of ferrite decreased and bainite was generated, which lead to a decrease in EL and caused press cracking.

For steel S59, the cooling rate was slow, and thus the average crystal grain size of ferrite became coarse and rough surface occurred, and dissolved Nb decreased and hardness after softnitriding was not ensured.

For steel S60, the cooling rate to 800° C. was high, and thus the area fraction of ferrite decreased, which lead to a decrease in EL and caused press cracking.

For steel S61, the heating temperature in hot rolling was low, which lead to a decrease in dissolved Nb, and thus hardness after softnitriding was not ensured.

For steel S62, the finish rolling temperature was high, which lead to a decrease in dissolved Nb, and thus hardness after softnitriding was not ensured. On the other hand, for steel S63, the finish rolling temperature was low, and coarse, flat ferrite occurred halfway through hot rolling. This lead to large anisotropy in press working and caused a decrease in EL.

For steel S64, the cooling rate to 800° C. was high, and thus the area fraction of ferrite decreased and bainite was generated, which lead to an increase in TS and a decrease in EL. On the other hand, for steel S65, the cooling rate to 800° C. was low, which lead to a decrease in dissolved Nb, and thus hardness after softnitriding was not ensured.

For steel S66, the cooling rate from 800° C. to the coiling temperature was high, and thus the area fraction of ferrite decreased, which lead to a decrease in EL and caused press cracking. On the other hand, for steel S67, the cooling rate from 800° C. to the coiling temperature was low, which lead to a decrease in dissolved Nb, and thus hardness after softnitriding was not ensured.

For steel S68, the coiling temperature was high, which lead to a decrease in dissolved Nb, and thus hardness after softnitriding was not ensured. On the other hand, for steel S69, the coiling temperature was low, and the area fraction of ferrite decreased and bainite was generated, which lead to a decrease in EL and caused press cracking.

For steel S71, the heating temperature in hot rolling was low, and thus dissolved Nb was not sufficiently generated. Because of the small amount of dissolved Nb, hardness was not ensured even by high-temperature softnitriding treatment.

Steel S74, steel S75, and steel S76 are hot-rolled steel sheets that were obtained by hot-rolling a slab with a low Nb content under the same conditions. The difference between them is that a work hardening rate was changed by changing the measurement position of Vickers hardness in the press-formed product. In all of these cases, dissolved Nb was not sufficiently generated. Therefore, hardness after softnitriding was not ensured in an area worked to a high degree, as in steel S74 and steel S75, and hardness after softnitriding was not ensured in an area worked to a low degree, as in steel S76.

Steel S77 and steel S78 are steels with a small amount of dissolved Nb and a high Nb content; hardness after softnitriding was ensured in the case where the work hardening rate was high. On the other hand, even in steels with a small amount of dissolved Nb and a high Nb content, like steel S59, steel S61, steel S62, steel S65, steel S67, steel S68, and steel S84, hardness after softnitriding was not ensured in the case where the work hardening rate was low.

Steel S81 and steel S82 are examples obtained in the following manner: hot-rolled steel sheets that were obtained by hot-rolling a slab with a low Nb content under substantially the same conditions were subjected to press working, and further subjected to heating treatment at a high temperature of more than 620° C. The difference between S81 and S82 is that a work hardening rate was changed by changing the measurement position of Vickers hardness in the press-formed product. The difference from S53 and S74 to S76 is that heating treatment was performed at a high temperature of more than 620° C. In both of S81 and S82, dissolved Nb was not sufficiently generated because the Nb content was extremely small. Therefore, hardness after softnitriding was not ensured in an area worked to a high degree, as in steel S81, and hardness after softnitriding was not ensured in an area worked to a low degree, as in steel S82.

Steel S83 contained dissolved Nb, but had a small C content. Therefore, a small amount of NbC was generated when thermal treatment of softnitriding treatment was performed, and thus hardness was not ensured even by heating treatment at a high temperature of more than 620° C.

TABLE 1A (mass %)

| Components | C | Si | Mn | P | S | Al | N | Nb | |
|---|---|---|---|---|---|---|---|---|---|
| 1 | 0.040 | 0.025 | 1.05 | 0.006 | 0.0070 | 0.026 | 0.0035 | 0.016 | Present Invention |
| 2 | 0.150 | 0.025 | 1.05 | 0.006 | 0.0070 | 0.026 | 0.0028 | 0.016 | Present Invention |
| 3 | 0.085 | 0.015 | 1.05 | 0.006 | 0.0070 | 0.026 | 0.0033 | 0.016 | Present Invention |
| 4 | 0.085 | 0.003 | 1.05 | 0.006 | 0.0070 | 0.026 | 0.0031 | 0.016 | Present Invention |
| 5 | 0.085 | 0.500 | 1.05 | 0.006 | 0.0070 | 0.026 | 0.0028 | 0.016 | Present Invention |
| 6 | 0.085 | 0.025 | 0.10 | 0.006 | 0.0070 | 0.026 | 0.0031 | 0.016 | Present Invention |
| 7 | 0.085 | 0.025 | 1.50 | 0.006 | 0.0070 | 0.026 | 0.0031 | 0.016 | Present Invention |
| 8 | 0.085 | 0.025 | 1.05 | 0.001 | 0.0070 | 0.026 | 0.0031 | 0.016 | Present Invention |
| 9 | 0.085 | 0.025 | 1.05 | 0.050 | 0.0070 | 0.026 | 0.0035 | 0.016 | Present Invention |
| 10 | 0.085 | 0.025 | 1.05 | 0.004 | 0.0003 | 0.026 | 0.0035 | 0.016 | Present Invention |
| 11 | 0.085 | 0.025 | 1.05 | 0.005 | 0.0200 | 0.026 | 0.0028 | 0.016 | Present Invention |
| 12 | 0.085 | 0.025 | 1.05 | 0.004 | 0.0070 | 0.010 | 0.0028 | 0.016 | Present Invention |
| 13 | 0.085 | 0.025 | 1.05 | 0.004 | 0.0070 | 0.050 | 0.0028 | 0.016 | Present Invention |
| 14 | 0.085 | 0.025 | 1.05 | 0.004 | 0.0070 | 0.026 | 0.0015 | 0.016 | Present Invention |
| 15 | 0.085 | 0.025 | 1.05 | 0.004 | 0.0070 | 0.026 | 0.0060 | 0.016 | Present Invention |
| 16 | 0.085 | 0.025 | 1.05 | 0.004 | 0.0070 | 0.026 | 0.0032 | 0.008 | Present Invention |
| 17 | 0.085 | 0.025 | 1.05 | 0.004 | 0.0070 | 0.026 | 0.0025 | 0.035 | Present Invention |
| 18 | 0.085 | 0.025 | 1.05 | 0.006 | 0.0070 | 0.026 | 0.0028 | 0.012 | Present Invention |
| 19 | 0.085 | 0.025 | 1.05 | 0.006 | 0.0070 | 0.026 | 0.0032 | 0.035 | Present Invention |
| 20 | 0.085 | 0.025 | 1.05 | 0.006 | 0.0070 | 0.026 | 0.0018 | 0.016 | Present Invention |
| 21 | 0.085 | 0.025 | 1.05 | 0.006 | 0.0070 | 0.026 | 0.0019 | 0.016 | Present Invention |
| 22 | 0.085 | 0.025 | 1.05 | 0.006 | 0.0060 | 0.026 | 0.0032 | 0.016 | Present Invention |
| 23 | 0.085 | 0.025 | 1.05 | 0.006 | 0.0060 | 0.026 | 0.0021 | 0.016 | Present Invention |
| 24 | 0.085 | 0.025 | 1.05 | 0.006 | 0.0060 | 0.026 | 0.0021 | 0.016 | Present Invention |
| 25 | 0.085 | 0.025 | 1.05 | 0.006 | 0.0060 | 0.026 | 0.0021 | 0.016 | Present Invention |
| 26 | 0.085 | 0.025 | 1.05 | 0.006 | 0.0060 | 0.026 | 0.0021 | 0.016 | Present Invention |
| 27 | 0.041 | 0.006 | 0.52 | 0.004 | 0.0070 | 0.015 | 0.0018 | 0.011 | Present Invention |
| 28 | 0.005 | 0.025 | 1.05 | 0.006 | 0.0070 | 0.026 | 0.0035 | 0.016 | Comparative Steel |
| 29 | 0.210 | 0.025 | 1.05 | 0.006 | 0.0060 | 0.026 | 0.0031 | 0.016 | Comparative Steel |
| 30 | 0.093 | 2.030 | 1.36 | 0.004 | 0.0080 | 0.045 | 0.0025 | 0.016 | Comparative Steel |
| 31 | 0.085 | 0.025 | 0.05 | 0.006 | 0.0060 | 0.026 | 0.0028 | 0.016 | Comparative Steel |
| 32 | 0.085 | 0.025 | 2.23 | 0.005 | 0.0060 | 0.026 | 0.0022 | 0.016 | Comparative Steel |
| 33 | 0.085 | 0.025 | 1.05 | 0.085 | 0.0060 | 0.026 | 0.0026 | 0.016 | Comparative Steel |
| 34 | 0.085 | 0.025 | 1.05 | 0.006 | 0.0350 | 0.026 | 0.0029 | 0.016 | Comparative Steel |
| 35 | 0.085 | 0.025 | 1.05 | 0.006 | 0.0060 | 0.005 | 0.0034 | 0.016 | Comparative Steel |
| 36 | 0.085 | 0.025 | 1.05 | 0.006 | 0.0060 | 0.361 | 0.0031 | 0.016 | Comparative Steel |
| 37 | 0.085 | 0.025 | 1.05 | 0.006 | 0.0060 | 0.026 | 0.0095 | 0.016 | Comparative Steel |
| 38 | 0.085 | 0.025 | 1.05 | 0.006 | 0.0060 | 0.026 | 0.0021 | 0.001 | Comparative Steel |
| 39 | 0.085 | 0.025 | 1.05 | 0.006 | 0.0060 | 0.026 | 0.0026 | 0.056 | Comparative Steel |
| 40 | 0.085 | 0.025 | 1.05 | 0.006 | 0.0060 | 0.026 | 0.0024 | 0.016 | Present Invention |
| 41 | 0.085 | 0.025 | 1.05 | 0.006 | 0.0060 | 0.026 | 0.0031 | 0.055 | Comparative Steel |
| 42 | 0.085 | 0.025 | 1.05 | 0.006 | 0.0060 | 0.026 | 0.0045 | 0.016 | Comparative Steel |

40

TABLE 1B (mass %)

| Components | Cu | Ni | Cr | Mo | V | Ca | B | |
|---|---|---|---|---|---|---|---|---|
| 1 | — | — | — | — | — | — | — | Present Invention |
| 2 | — | — | — | — | — | — | — | Present Invention |
| 3 | — | — | — | — | — | — | — | Present Invention |
| 4 | — | — | — | — | — | — | — | Present Invention |
| 5 | — | — | — | — | — | — | — | Present Invention |
| 6 | — | — | — | — | — | — | — | Present Invention |
| 7 | — | — | — | — | — | — | — | Present Invention |
| 8 | — | — | — | — | — | — | — | Present Invention |
| 9 | — | — | — | — | — | — | — | Present Invention |
| 10 | — | — | — | — | — | — | — | Present Invention |
| 11 | — | — | — | — | — | — | — | Present Invention |
| 12 | — | — | — | — | — | — | — | Present Invention |
| 13 | — | — | — | — | — | — | — | Present Invention |
| 14 | — | — | — | — | — | — | — | Present Invention |
| 15 | — | — | — | — | — | — | — | Present Invention |
| 16 | — | — | — | — | — | — | — | Present Invention |
| 17 | — | — | — | — | — | — | — | Present Invention |
| 18 | — | — | — | — | — | — | — | Present Invention |
| 19 | — | — | — | — | — | — | — | Present Invention |
| 20 | — | — | — | — | — | — | — | Present Invention |
| 21 | 0.10 | 0.05 | — | — | — | — | — | Present Invention |
| 22 | — | — | 0.02 | — | — | — | — | Present Invention |
| 23 | — | — | — | 0.020 | — | — | — | Present Invention |
| 24 | — | — | — | — | 0.020 | — | — | Present Invention |
| 25 | — | — | — | — | — | 0.0100 | — | Present Invention |

TABLE 1B-continued (mass %)

| Components | Cu | Ni | Cr | Mo | V | Ca | B | |
|---|---|---|---|---|---|---|---|---|
| 26 | — | — | — | — | — | — | 0.0050 | Present Invention |
| 27 | 0.04 | 0.03 | 0.02 | 0.012 | 0.014 | 0.0018 | 0.0004 | Present Invention |
| 28 | — | — | — | — | — | — | — | Comparative Steel |
| 29 | — | — | — | — | — | — | — | Comparative Steel |
| 30 | — | — | — | — | — | — | — | Comparative Steel |
| 31 | — | — | — | — | — | — | — | Comparative Steel |
| 32 | — | — | — | — | — | — | — | Comparative Steel |
| 33 | — | — | — | — | — | — | — | Comparative Steel |
| 34 | — | — | — | — | — | — | — | Comparative Steel |
| 35 | — | — | — | — | — | — | — | Comparative Steel |
| 36 | — | — | — | — | — | — | — | Comparative Steel |
| 37 | — | — | — | — | — | — | — | Comparative Steel |
| 38 | — | — | — | — | — | — | — | Comparative Steel |
| 39 | — | — | — | — | — | — | — | Comparative Steel |
| 40 | — | — | — | — | — | — | — | Present Invention |
| 41 | — | — | — | — | — | — | — | Comparative Steel |
| 42 | — | — | — | — | — | — | 0.0075 | Comparative Steel |

TABLE 2A

| | | Production condistions | | | | | |
|---|---|---|---|---|---|---|---|
| | | | Finish rolling Rolling | Cooling | | | |
| Steel No. | Components | Heating step Heating temperature (° C.) | temperature in final rolling (° C.) | Cooling rate I (° C./sec) | Cooling rate II (° C./sec) | Colling temperature (° C.) | Sheet thickness of hot-rolled original sheet (mm) |
| S01 | 1 | 1220 | 880 | 55 | 55 | 530 | 4.5 |
| S02 | 2 | 1220 | 860 | 55 | 55 | 530 | 4.5 |
| S03 | 3 | 1220 | 900 | 55 | 55 | 530 | 4.5 |
| S04 | 4 | 1220 | 860 | 55 | 55 | 530 | 4.5 |
| S05 | 5 | 1220 | 860 | 55 | 55 | 530 | 4.5 |
| S06 | 6 | 1220 | 860 | 55 | 55 | 530 | 4.5 |
| S07 | 7 | 1220 | 910 | 55 | 55 | 530 | 4.5 |
| S08 | 8 | 1220 | 910 | 55 | 55 | 530 | 4.5 |
| S09 | 9 | 1220 | 910 | 55 | 55 | 530 | 4.5 |
| S10 | 10 | 1220 | 910 | 55 | 55 | 530 | 4.5 |
| S11 | 11 | 1220 | 910 | 55 | 55 | 530 | 4.5 |
| S12 | 12 | 1220 | 910 | 55 | 55 | 530 | 4.5 |
| S13 | 13 | 1220 | 910 | 55 | 55 | 530 | 4.5 |
| S14 | 14 | 1220 | 910 | 55 | 55 | 530 | 4.5 |
| S15 | 15 | 1220 | 910 | 55 | 55 | 530 | 4.5 |
| S16 | 16 | 1220 | 910 | 55 | 55 | 530 | 4.5 |
| S17 | 17 | 1220 | 910 | 55 | 55 | 530 | 4.5 |
| S18 | 18 | 1220 | 910 | 55 | 55 | 530 | 4.5 |
| S19 | 19 | 1220 | 910 | 55 | 55 | 530 | 4.5 |
| S20 | 20 | 1220 | 910 | 55 | 55 | 530 | 4.5 |
| S21 | 21 | 1220 | 910 | 55 | 55 | 530 | 4.5 |
| S22 | 22 | 1220 | 910 | 55 | 55 | 530 | 4.5 |
| S23 | 23 | 1220 | 910 | 55 | 55 | 530 | 4.5 |
| S24 | 24 | 1220 | 910 | 55 | 55 | 530 | 4.5 |
| S25 | 25 | 1220 | 910 | 55 | 55 | 530 | 4.5 |
| S26 | 26 | 1220 | 910 | 55 | 55 | 530 | 4.5 |
| S27 | 27 | 1220 | 910 | 55 | 55 | 570 | 4.5 |
| S28 | 3 | 1220 | 910 | 100 | 100 | 530 | 4.5 |

| | Microstructure of hot-rolled original sheet | | | | | | |
|---|---|---|---|---|---|---|---|
| | | Average crystal grain | Area fraction of | Dissolved | Mechanical characteristics | | |
| Steel No. | Microstructure (—) | size of ferrite (μm) | ferrite (%) | Nb (mass %) | TS (MPa) | EL (%) | |
| S01 | F | 19 | 95 | 0.011 | 402 | 44.0 | Present Invention |
| S02 | F + P | 5 | 86 | 0.011 | 625 | 30.1 | Present Invention |
| S03 | F | 12 | 92 | 0.011 | 456 | 37.6 | Present Invention |
| S04 | F | 13 | 92 | 0.011 | 452 | 39.5 | Present Invention |
| S05 | F | 10 | 91 | 0.011 | 485 | 37.1 | Present Invention |
| S06 | F | 16 | 94 | 0.011 | 411 | 42.1 | Present Invention |
| S07 | F | 8 | 89 | 0.011 | 523 | 34.5 | Present Invention |

TABLE 2A-continued

| | | | | | | | |
|---|---|---|---|---|---|---|---|
| S08 | F | 12 | 92 | 0.011 | 463 | 39.1 | Present Invention |
| S09 | F | 9 | 90 | 0.011 | 502 | 35.1 | Present Invention |
| S10 | F | 13 | 93 | 0.011 | 441 | 39.7 | Present Invention |
| S11 | F | 9 | 92 | 0.011 | 462 | 38.6 | Present Invention |
| S12 | F | 12 | 92 | 0.011 | 471 | 37.5 | Present Invention |
| S13 | F | 10 | 91 | 0.011 | 489 | 36.5 | Present Invention |
| S14 | F | 11 | 92 | 0.011 | 448 | 39.2 | Present Invention |
| S15 | F | 8 | 91 | 0.011 | 493 | 36.1 | Present Invention |
| S16 | F | 14 | 94 | 0.005 | 418 | 41.5 | Present Invention |
| S17 | F + P | 8 | 89 | 0.028 | 569 | 30.7 | Present Invention |
| S18 | F | 14 | 91 | 0.005 | 493 | 35.6 | Present Invention |
| S19 | F | 8 | 92 | 0.030 | 455 | 38.7 | Present Invention |
| S20 | F | 13 | 92 | 0.011 | 461 | 37.9 | Present Invention |
| S21 | F + P | 10 | 89 | 0.011 | 583 | 31.5 | Present Invention |
| S22 | F + P | 11 | 89 | 0.011 | 554 | 31.6 | Present Invention |
| S23 | F | 10 | 88 | 0.011 | 531 | 33.2 | Present Invention |
| S24 | F + P | 10 | 87 | 0.011 | 564 | 31.1 | Present Invention |
| S25 | F | 11 | 92 | 0.011 | 480 | 36.4 | Present Invention |
| S26 | F | 10 | 92 | 0.011 | 453 | 37.4 | Present Invention |
| S27 | F | 6 | 87 | 0.008 | 502 | 30.2 | Present Invention |
| S28 | F + P | 5 | 88 | 0.013 | 536 | 32.1 | Present Invention |

TABLE 2B

| | | Production conditions | | | | | |
|---|---|---|---|---|---|---|---|
| | | Heating step | Finish rolling Rolling temperature | Cooling | | | Sheet thickness |
| Steel No. | Components | Heating temperature (° C.) | in final rolling (° C.) | Cooling rate I (° C./sec) | Cooling rate II (° C./sec) | Colling temperature (° C.) | of hot-rolled original sheet (mm) |
| S29 | 3 | 1220 | 910 | 30 | 10 | 530 | 4.5 |
| S30 | 3 | 1220 | 910 | 55 | 55 | 530 | 4.5 |
| S31 | 3 | 1220 | 910 | 78 | 60 | 530 | 2.0 |
| S32 | 3 | 1220 | 910 | 40 | 30 | 530 | 9.0 |
| S33 | 3 | 1300 | 910 | 55 | 55 | 530 | 4.5 |
| S34 | 3 | 1200 | 910 | 55 | 55 | 530 | 4.5 |
| S35 | 3 | 1220 | 950 | 55 | 55 | 530 | 4.5 |
| S36 | 3 | 1220 | 860 | 55 | 55 | 530 | 4.5 |
| S37 | 3 | 1220 | 910 | 100 | 55 | 530 | 4.5 |
| S38 | 3 | 1220 | 910 | 30 | 55 | 530 | 4.5 |
| S39 | 3 | 1220 | 910 | 100 | 100 | 530 | 4.5 |
| S40 | 3 | 1220 | 910 | 70 | 5 | 530 | 4.5 |
| S41 | 3 | 1220 | 910 | 80 | 55 | 600 | 4.5 |
| S42 | 3 | 1220 | 910 | 50 | 55 | 300 | 4.5 |
| S43 | 28 | 1220 | 910 | 40 | 40 | 530 | 4.5 |
| S44 | 29 | 1220 | 910 | 40 | 40 | 530 | 4.5 |
| S45 | 30 | 1220 | 910 | 40 | 40 | 530 | 4.5 |
| S46 | 31 | 1220 | 910 | 40 | 40 | 530 | 4.5 |
| S47 | 32 | 1220 | 910 | 40 | 40 | 530 | 4.5 |
| S48 | 33 | 1220 | 910 | 40 | 40 | 530 | 4.5 |
| S49 | 34 | 1220 | 910 | 40 | 40 | 530 | 4.5 |
| S50 | 35 | 1220 | 910 | 40 | 40 | 530 | 4.5 |
| S51 | 36 | 1220 | 910 | 90 | 40 | 530 | 4.5 |
| S52 | 37 | 1220 | 910 | 60 | 55 | 530 | 4.5 |
| S53 | 38 | 1220 | 910 | 40 | 40 | 530 | 4.5 |
| S54 | 39 | 1220 | 910 | 90 | 40 | 530 | 4.5 |
| S55 | 40 | 1180 | 910 | 25 | 2 | 670 | 4.5 |
| S56 | 41 | 1220 | 910 | 120 | 120 | 150 | 4.5 |

| | Microstructure of hot-rolled original sheet | | | | Mechanical characteristics | | |
|---|---|---|---|---|---|---|---|
| Steel No. | Microstructure (—) | Average crystal grain size of ferrite (μm) | Area fraction of ferrite (%) | Dissolved Nb (mass %) | TS (MPa) | EL (%) | |
| S29 | F | 20 | 92 | 0.008 | 455 | 39.4 | Present Invention |
| S30 | F + P | 6 | 87 | 0.011 | 587 | 30.1 | Present Invention |
| S31 | F | 10 | 92 | 0.012 | 476 | 34.8 | Present Invention |
| S32 | F | 13 | 92 | 0.011 | 458 | 40.5 | Present Invention |
| S33 | F | 10 | 91 | 0.011 | 493 | 35.5 | Present Invention |
| S34 | F | 11 | 92 | 0.011 | 470 | 38.0 | Present Invention |

TABLE 2B-continued

| | | | | | | | |
|---|---|---|---|---|---|---|---|
| S35 | F | 12 | 90 | 0.012 | 448 | 39.2 | Present Invention |
| S36 | F | 11 | 93 | 0.010 | 484 | 37.0 | Present Invention |
| S37 | F | 9 | 88 | 0.012 | 546 | 32.0 | Present Invention |
| S38 | F | 12 | 92 | 0.009 | 463 | 37.5 | Present Invention |
| S39 | F | 10 | 92 | 0.013 | 472 | 36.5 | Present Invention |
| S40 | F | 11 | 92 | 0.008 | 465 | 37.1 | Present Invention |
| S41 | F | 14 | 91 | 0.011 | 475 | 36.5 | Present Invention |
| S42 | F | 8 | 92 | 0.011 | 487 | 34.2 | Present Invention |
| S43 | F | 26 | 96 | 0.011 | 338 | 44.2 | Comparative Steel |
| S44 | F + P | 10 | 71 | 0.011 | 621 | 24.1 | Comparative Steel |
| S45 | F | 11 | 80 | 0.011 | 655 | 23.0 | Comparative Steel |
| S46 | F | 21 | 92 | 0.011 | 412 | 38.0 | Comparative Steel |
| S47 | F + B | 4 | 73 | 0.011 | 668 | 22.5 | Comparative Steel |
| S48 | F + B | 6 | 80 | 0.011 | 659 | 23.0 | Comparative Steel |
| S49 | F | 9 | 91 | 0.011 | 551 | 24.8 | Comparative Steel |
| S50 | F | 26 | 92 | 0.011 | 445 | 38.1 | Comparative Steel |
| S51 | F | 10 | 91 | 0.011 | 520 | 24.8 | Comparative Steel |
| S52 | F | 6 | 86 | 0.011 | 506 | 22.0 | Comparative Steel |
| S53 | F | 12 | 95 | 0.000 | 402 | 44.5 | Comparative Steel |
| S54 | F + B | 6 | 78 | 0.042 | 698 | 20.0 | Comparative Steel |
| S55 | F | 14 | 91 | 0.002 | 447 | 40.1 | Comparative Steel |
| S56 | F + P | 4 | 68 | 0.035 | 785 | 18.0 | Comparative Steel |

TABLE 2C

| | | Production conditions | | | | | |
|---|---|---|---|---|---|---|---|
| | | Heating step | Finish rolling Rolling temperature | Cooling | | | Sheet thickness |
| Steel No. | Components | Heating temperature (° C.) | in final rolling (° C.) | Cooling rate I (° C./sec) | Cooling rate II (° C./sec) | Colling temperature (° C.) | of hot-rolled original sheet (mm) |
| S57 | 42 | 1220 | 910 | 40 | 40 | 530 | 4.5 |
| S58 | 3 | 1220 | 910 | 120 | 120 | 260 | 4.5 |
| S59 | 3 | 1220 | 950 | 25 | 4 | 580 | 4.5 |
| S60 | 3 | 1220 | 910 | 120 | 100 | 530 | 3.5 |
| S61 | 3 | 1150 | 910 | 40 | 40 | 580 | 4.5 |
| S62 | 3 | 1230 | 990 | 40 | 40 | 530 | 4.5 |
| S63 | 3 | 1230 | 810 | 40 | 40 | 530 | 4.5 |
| S64 | 3 | 1230 | 910 | 180 | 100 | 400 | 3.0 |
| S65 | 3 | 1230 | 910 | 7 | 15 | 530 | 4.5 |
| S66 | 3 | 1230 | 910 | 30 | 135 | 450 | 4.5 |
| S67 | 3 | 1230 | 910 | 30 | 4 | 580 | 4.5 |
| S68 | 3 | 1230 | 910 | 30 | 55 | 690 | 4.5 |
| S69 | 3 | 1230 | 880 | 120 | 120 | 150 | 4.5 |
| S70 | 3 | 1220 | 860 | 55 | 55 | 530 | 4.5 |
| S71 | 40 | 1180 | 890 | 30 | 30 | 580 | 4.5 |
| S72 | 3 | 1220 | 900 | 55 | 55 | 530 | 4.5 |
| S73 | 3 | 1220 | 900 | 55 | 55 | 530 | 4.5 |
| S74 | 38 | 1220 | 910 | 30 | 55 | 530 | 4.5 |
| S75 | 38 | 1220 | 910 | 30 | 55 | 530 | 4.5 |
| S76 | 38 | 1220 | 910 | 30 | 55 | 530 | 4.5 |
| S77 | 3 | 1230 | 910 | 7 | 15 | 530 | 4.5 |
| S78 | 20 | 1150 | 910 | 20 | 20 | 600 | 4.5 |
| S79 | 3 | 1220 | 900 | 56 | 65 | 530 | 4.5 |
| S80 | 18 | 1220 | 910 | 55 | 55 | 530 | 4.5 |
| S81 | 38 | 1220 | 910 | 30 | 55 | 530 | 4.5 |
| S82 | 38 | 1220 | 910 | 30 | 55 | 530 | 4.5 |
| S83 | 28 | 1220 | 910 | 40 | 40 | 530 | 4.5 |
| S84 | 20 | 1160 | 900 | 20 | 20 | 600 | 4.5 |

| | Microstructure of hot-rolled original sheet | | | | Mechanical characteristics | | |
|---|---|---|---|---|---|---|---|
| Steel No. | Microstructure (—) | Average crystal grain size of ferrite (μm) | Area fraction of ferrite (%) | Dissolved Nb (mass %) | TS (MPa) | EL (%) | |
| S57 | F | 7 | 93 | 0.011 | 489 | 32.0 | Comparative Steel |
| S58 | F+B | 4 | 68 | 0.011 | 513 | 23.4 | Comparative Steel |
| S59 | F | 23 | 96 | 0.004 | 440 | 39.0 | Comparative Steel |
| S60 | F + B | 4 | 80 | 0.011 | 642 | 24.1 | Comparative Steel |
| S61 | F | 12 | 92 | 0.004 | 452 | 38.5 | Comparative Steel |

TABLE 2C-continued

| | | | | | | | |
|---|---|---|---|---|---|---|---|
| S62 | F | 14 | 92 | 0.003 | 458 | 37.5 | Comparative Steel |
| S63 | F | 26 | 91 | 0.011 | 489 | 21.0 | Comparative Steel |
| S64 | F + B | 4 | 74 | 0.011 | 673 | 24.3 | Comparative Steel |
| S65 | F | 14 | 94 | 0.003 | 459 | 38.0 | Comparative Steel |
| S66 | F + B | 7 | 81 | 0.011 | 652 | 23.0 | Comparative Steel |
| S67 | F | 11 | 92 | 0.003 | 453 | 38.9 | Comparative Steel |
| S68 | F | 14 | 95 | 0.003 | 502 | 35.1 | Comparative Steel |
| S69 | F + B | 4 | 71 | 0.012 | 663 | 23.5 | Comparative Steel |
| S70 | F | 12 | 92 | 0.011 | 456 | 37.6 | Present Invention |
| S71 | F | 14 | 92 | 0.002 | 447 | 40.1 | Comparative Steel |
| S72 | F | 12 | 92 | 0.011 | 466 | 37.6 | Present Invention |
| S73 | F | 12 | 92 | 0.011 | 466 | 37.6 | Present Invention |
| S74 | F | 12 | 94 | 0.000 | 402 | 44.5 | Comparative Steel |
| S75 | F | 12 | 94 | 0.000 | 402 | 44.5 | Comparative Steel |
| S76 | F | 12 | 94 | 0.000 | 402 | 44.5 | Comparative Steel |
| S77 | F | 14 | 94 | 0.003 | 459 | 38.0 | Comparative Steel |
| S78 | F | 21 | 93 | 0.004 | 441 | 39.0 | Comparative Steel |
| S79 | F | 12 | 92 | 0.011 | 466 | 37.6 | Present Invention |
| S80 | F | 14 | 91 | 0.008 | 493 | 35.6 | Present Invention |
| S81 | F | 12 | 94 | 0.000 | 402 | 44.5 | Comparative Steel |
| S82 | F | 12 | 94 | 0.000 | 402 | 44.5 | Comparative Steel |
| S83 | F | 28 | 96 | 0.011 | 338 | 44.2 | Comparative Steel |
| S84 | F | 21 | 93 | 0.004 | 441 | 39.0 | Comparative Steel |

TABLE 3A

| Steel No. | Press cracking (—) | Press earing (—) | Rough surface (—) | Hardness Before cold working (Hv) | Hardness After cold working (Hv) | Hardness measurement position (mm) | Amount of work hardening Δ WHv (Hv) | Work hardening rate Δ R (%) |
|---|---|---|---|---|---|---|---|---|
| S01 | N | B | A | 123 | 158 | 7 | 35 | 28 |
| S02 | N | B | A | 191 | 232 | 5 | 41 | 21 |
| S03 | N | A | A | 142 | 184 | 7 | 42 | 30 |
| S04 | N | B | A | 138 | 178 | 7 | 40 | 29 |
| S05 | N | B | A | 148 | 181 | 5 | 33 | 22 |
| S06 | N | B | A | 125 | 160 | 7 | 35 | 28 |
| S07 | N | A | A | 160 | 205 | 7 | 45 | 28 |
| S08 | N | A | A | 141 | 183 | 7 | 42 | 30 |
| S09 | N | A | A | 153 | 198 | 7 | 45 | 29 |
| S10 | N | A | A | 135 | 174 | 7 | 39 | 29 |
| S11 | N | A | A | 141 | 182 | 7 | 41 | 29 |
| S12 | N | A | A | 144 | 187 | 7 | 43 | 30 |
| S13 | N | A | A | 149 | 193 | 7 | 44 | 30 |
| S14 | N | A | A | 137 | 177 | 7 | 40 | 29 |
| S15 | N | A | A | 150 | 191 | 7 | 41 | 27 |
| S16 | N | A | A | 127 | 165 | 7 | 38 | 30 |
| S17 | N | B | A | 174 | 225 | 7 | 51 | 29 |
| S18 | N | A | A | 150 | 193 | 7 | 43 | 29 |
| S19 | N | B | A | 139 | 178 | 7 | 39 | 28 |
| S20 | N | A | A | 140 | 160 | 3 | 20 | 14 |
| S21 | N | A | A | 172 | 211 | 5 | 39 | 23 |
| S22 | N | A | A | 169 | 219 | 7 | 50 | 30 |
| S23 | N | A | A | 162 | 210 | 7 | 48 | 30 |
| S24 | N | A | A | 172 | 221 | 7 | 49 | 28 |
| S25 | N | A | A | 146 | 169 | 7 | 43 | 29 |
| S26 | N | B | A | 141 | 182 | 7 | 41 | 29 |
| S27 | N | B | A | 184 | 228 | 5 | 33 | 17 |
| S28 | N | A | A | 164 | 213 | 7 | 49 | 30 |

| Steel No. | Thermal treatment temperature (° C.) | Hardness after thermal treatment Hv (after thermal treatment) (Hv) | Amount of hardening after thermal treatment Δ THv (Hv) | Rate of change in hardness after thermal treatment Δ THv/Δ WHv (%) | Evaluation result of rate of change in hardness after thermal treatment (—) | |
|---|---|---|---|---|---|---|
| S01 | 570 | 161 | 38 | 109 | A | Present Invention |
| S02 | 580 | 241 | 50 | 122 | A | Present Invention |
| S03 | 580 | 191 | 49 | 117 | A | Present Invention |
| S04 | 580 | 180 | 52 | 130 | A | Present Invention |
| S05 | 580 | 185 | 37 | 112 | A | Present Invention |

TABLE 3A-continued

| | | | | | | |
|---|---|---|---|---|---|---|
| S06 | 580 | 165 | 40 | 114 | A | Present Invention |
| S07 | 570 | 210 | 50 | 111 | A | Present Invention |
| S08 | 580 | 191 | 50 | 119 | A | Present Invention |
| S09 | 580 | 205 | 52 | 116 | A | Present Invention |
| S10 | 585 | 181 | 46 | 118 | A | Present Invention |
| S11 | 580 | 188 | 47 | 115 | A | Present Invention |
| S12 | 580 | 198 | 54 | 126 | A | Present Invention |
| S13 | 580 | 202 | 53 | 120 | A | Present Invention |
| S14 | 580 | 185 | 48 | 120 | A | Present Invention |
| S15 | 580 | 200 | 50 | 122 | A | Present Invention |
| S16 | 580 | 168 | 41 | 108 | A | Present Invention |
| S17 | 620 | 230 | 56 | 110 | A | Present Invention |
| S18 | 570 | 195 | 46 | 107 | A | Present Invention |
| S19 | 580 | 191 | 52 | 133 | A | Present Invention |
| S20 | 620 | 161 | 21 | 105 | A | Present Invention |
| S21 | 590 | 218 | 46 | 118 | A | Present Invention |
| S22 | 580 | 228 | 59 | 118 | A | Present Invention |
| S23 | 580 | 222 | 60 | 125 | A | Present Invention |
| S24 | 580 | 231 | 59 | 120 | A | Present Invention |
| S25 | 580 | 195 | 49 | 114 | A | Present Invention |
| S26 | 580 | 188 | 47 | 115 | A | Present Invention |
| S27 | 620 | 242 | 21 | 142 | A | Present Invention |
| S28 | 580 | 218 | 54 | 110 | A | Present Invention |

TABLE 3B

| Steel No. | Press cracking (—) | Press earing (—) | Rough surface (—) | Hardness: Before cold working (Hv) | Hardness: After cold working (Hv) | Hardness measurement position (mm) | Amount of work hardening Δ WHv (Hv) | Work hardening rate Δ R (%) |
|---|---|---|---|---|---|---|---|---|
| S29 | N | B | A | 139 | 180 | 7 | 41 | 29 |
| S30 | N | B | A | 179 | 232 | 7 | 53 | 30 |
| S31 | N | A | A | 145 | 188 | 7 | 43 | 30 |
| S32 | N | A | A | 140 | 180 | 7 | 40 | 29 |
| S33 | N | A | A | 150 | 194 | 7 | 44 | 29 |
| S34 | N | A | A | 143 | 185 | 7 | 42 | 29 |
| S35 | N | A | A | 137 | 174 | 7 | 37 | 27 |
| S36 | N | B | A | 148 | 190 | 7 | 42 | 28 |
| S37 | N | A | A | 167 | 211 | 7 | 44 | 26 |
| S38 | N | A | A | 141 | 181 | 7 | 40 | 28 |
| S39 | N | A | A | 144 | 185 | 7 | 41 | 28 |
| S40 | N | A | A | 142 | 182 | 7 | 40 | 28 |
| S41 | N | A | A | 145 | 187 | 7 | 42 | 29 |
| S42 | N | A | A | 149 | 190 | 7 | 41 | 28 |
| S43 | N | B | B | 120 | 152 | 7 | 32 | 27 |
| S44 | E, S | — | — | — | — | — | — | — |
| S45 | E, S | — | — | — | — | — | — | — |
| S46 | N | B | B | 126 | 163 | 7 | 37 | 29 |
| S47 | E | — | — | — | — | — | — | — |
| S48 | E | — | — | — | — | — | — | — |
| S49 | S | — | — | — | — | — | — | — |
| S50 | N | B | B | 136 | 176 | 7 | 40 | 29 |
| S51 | S | — | — | — | — | — | — | — |
| S52 | S | — | — | — | — | — | — | — |
| S53 | N | A | A | 123 | 158 | 7 | 35 | 28 |
| S54 | S | — | — | — | — | — | — | — |
| S55 | N | B | A | 136 | 175 | 7 | 39 | 29 |
| S56 | E, S | — | — | — | — | — | — | — |

| Steel No. | Thermal treatment temperature (° C.) | Hardness after thermal treatment Hv (after thermal treatment) (Hv) | Amount of hardening after thermal treatment Δ THv (Hv) | Rate of change in hardness after thermal treatment Δ THv/Δ WHv (%) | Evaluation result of rate of change in hardness after thermal treatment (—) | |
|---|---|---|---|---|---|---|
| S29 | 580 | 190 | 51 | 124 | A | Present Invention |
| S30 | 580 | 235 | 57 | 108 | A | Present Invention |
| S31 | 580 | 196 | 51 | 119 | A | Present Invention |
| S32 | 560 | 187 | 47 | 118 | A | Present Invention |
| S33 | 580 | 202 | 52 | 118 | A | Present Invention |

TABLE 3B-continued

| | | | | | | |
|---|---|---|---|---|---|---|
| S34 | 580 | 205 | 52 | 148 | A | Present Invention |
| S35 | 580 | 184 | 47 | 127 | A | Present Invention |
| S36 | 580 | 195 | 47 | 112 | A | Present Invention |
| S37 | 580 | 235 | 68 | 155 | A | Present Invention |
| S38 | 570 | 185 | 44 | 110 | A | Present Invention |
| S39 | 580 | 195 | 51 | 124 | A | Present Invention |
| S40 | 580 | 188 | 46 | 115 | A | Present Invention |
| S41 | 580 | 192 | 47 | 112 | A | Present Invention |
| S42 | 590 | 211 | 62 | 151 | A | Present Invention |
| S43 | 580 | 123 | 3 | 9 | B | Comparative Steel |
| S44 | — | — | — | — | — | Comparative Steel |
| S45 | — | — | — | — | — | Comparative Steel |
| S46 | 580 | 170 | 44 | 119 | A | Comparative Steel |
| S47 | — | — | — | — | — | Comparative Steel |
| S48 | — | — | — | — | — | Comparative Steel |
| S49 | — | — | — | — | — | Comparative Steel |
| S50 | 590 | 188 | 52 | 130 | A | Comparative Steel |
| S51 | — | — | — | — | — | Comparative Steel |
| S52 | — | — | — | — | — | Comparative Steel |
| S53 | 580 | 128 | 5 | 14 | B | Comparative Steel |
| S54 | — | — | — | — | — | Comparative Steel |
| S55 | 580 | 152 | 16 | 41 | B | Comparative Steel |
| S56 | — | — | — | — | — | Comparative Steel |

TABLE 3C

| Steel No. | Press cracking (—) | Press earing (—) | Rough surface (—) | Hardness: Before cold working (Hv) | Hardness: After cold working (Hv) | Hardness measurement position (mm) | Amount of work hardening Δ WHv (Hv) | Work hardening rate Δ R (%) |
|---|---|---|---|---|---|---|---|---|
| S57 | N | D | A | 149 | 193 | 7 | 44 | 30 |
| S58 | E | — | — | — | — | — | — | — |
| S59 | N | A | B | 134 | 173 | 7 | 39 | 29 |
| S60 | E, S | — | — | — | — | — | — | — |
| S61 | N | C | A | 138 | 177 | 7 | 39 | 28 |
| S62 | N | B | A | 140 | 182 | 7 | 42 | 30 |
| S63 | E, S | — | — | — | — | — | — | — |
| S64 | E | — | — | — | — | — | — | — |
| S65 | N | A | A | 140 | 180 | 7 | 40 | 29 |
| S66 | E | — | — | — | — | — | — | — |
| S67 | N | B | A | 138 | 174 | 7 | 36 | 26 |
| S68 | N | B | A | 153 | 198 | 7 | 45 | 29 |
| S69 | E, S | — | — | — | — | — | — | — |
| S70 | N | B | A | 142 | 184 | 7 | 42 | 30 |
| S71 | N | B | A | 136 | 175 | 7 | 39 | 29 |
| S72 | N | A | A | 142 | 237 | 25 | 95 | 67 |
| S73 | N | A | A | 142 | 254 | 35 | 112 | 79 |
| S74 | N | A | A | 123 | 205 | 25 | 82 | 67 |
| S75 | N | A | A | 123 | 266 | 35 | 143 | 116 |
| S76 | N | A | A | 123 | 142 | 5 | 19 | 15 |
| S77 | N | A | A | 140 | 248 | 35 | 108 | 77 |
| S78 | N | A | A | 135 | 227 | 25 | 92 | 58 |
| S79 | N | A | A | 142 | 184 | 7 | 42 | 30 |
| S80 | N | A | A | 150 | 193 | 7 | 43 | 29 |
| S81 | N | A | A | 123 | 205 | 25 | 82 | 67 |
| S82 | N | A | A | 123 | 142 | 5 | 19 | 15 |
| S83 | N | A | B | 120 | 152 | 7 | 32 | 27 |
| S84 | N | A | A | 135 | 175 | 7 | 40 | 30 |

| Steel No. | Thermal treatment temperature (° C.) | Hardness after thermal treatment Hv (after thermal treatment) (Hv) | Amount of hardening after thermal treatment Δ THv (Hv) | Rate of change in hardness after thermal treatment Δ THv/Δ WHv (%) | Evaluation result of rate of change in hardness after thermal treatment (—) | |
|---|---|---|---|---|---|---|
| S57 | 580 | 181 | 32 | 73 | B | Comparative Steel |
| S58 | — | — | — | — | — | Comparative Steel |
| S59 | 580 | 138 | 4 | 10 | B | Comparative Steel |
| S60 | — | — | — | — | — | Comparative Steel |
| S61 | 580 | 165 | 27 | 69 | B | Comparative Steel |

TABLE 3C-continued

| | | | | | | |
|---|---|---|---|---|---|---|
| S62 | 580 | 154 | 14 | 33 | B | Comparative Steel |
| S63 | — | — | — | — | — | Comparative Steel |
| S64 | — | — | — | — | — | Comparative Steel |
| S65 | 570 | 168 | 18 | 45 | B | Comparative Steel |
| S66 | — | — | — | — | — | Comparative Steel |
| S67 | 580 | 155 | 17 | 47 | B | Comparative Steel |
| S68 | 590 | 175 | 22 | 49 | B | Comparative Steel |
| S69 | — | — | — | — | — | Comparative Steel |
| S70 | 600 | 182 | 40 | 95 | A | Present Invention |
| S71 | 600 | 141 | 5 | 13 | B | Comparative Steel |
| S72 | 580 | 241 | 99 | 104 | A | Present Invention |
| S73 | 580 | 256 | 114 | 102 | A | Present Invention |
| S74 | 580 | 130 | 7 | 9 | B | Comparative Steel |
| S75 | 680 | 128 | 5 | 3 | B | Comparative Steel |
| S76 | 580 | 125 | 2 | 11 | B | Comparative Steel |
| S77 | 570 | 251 | 111 | 103 | A | Comparative Steel |
| S78 | 580 | 232 | 97 | 105 | A | Comparative Steel |
| S79 | 640 | 175 | 33 | 79 | B | Present Invention |
| S80 | 645 | 173 | 23 | 53 | B | Present Invention |
| S81 | 640 | 125 | 2 | 2 | B | Comparative Steel |
| S82 | 640 | 124 | 1 | 5 | B | Comparative Steel |
| S83 | 640 | 121 | 1 | 3 | B | Comparative Steel |
| S84 | 580 | 161 | 26 | 65 | B | Comparative Steel |

The embodiment(s) of the present invention has/have been described above, whilst the present invention is not limited to the illustrated examples. A person skilled in the art may find various alterations and modifications within the scope of the appended claims, and it should be understood that they will naturally come under the technical scope of the present invention.

The invention claimed is:

1. A hot-rolled steel sheet consisting of chemical components of, in mass %, C: 0.040 to 0.150%,
Si: 0 to 0.08%,
Mn: 0.10 to 1.50%,
P: 0 to 0.050%,
S: 0 to 0.020%,
Al: 0.010 to 0.050%,
N: 0.0010 to 0.0060%,
Nb: 0.008 to 0.035%,
Cu: 0 to 0.10%,
Ni: 0 to 0.10%,
Cr: 0 to 0.02%,
Mo: 0 to 0.020%,
V: 0 to 0.020%,
Ca: 0 to 0.0100%,
B: 0 to 0.0050%, and
the balance: Fe and impurities, wherein
the hot-rolled steel sheet contains 0.005 to 0.030% dissolved Nb, and
an area fraction of ferrite structure in a metal structure is 85% or more, the balance of the metal structure is cementite and/or pearlite structure, and an average crystal grain size of ferrite is equal to or more than 5 μm and equal to or less than 20 μm.

2. The hot-rolled steel sheet according to claim 1,
wherein Vickers hardness of a sheet-thickness central portion when cold working and thermal treatment of heating at 560 to 620° C. for 120 minutes are performed sequentially on the hot-rolled steel sheet exhibits resistance to softening of 80% or more with respect to Vickers hardness of the sheet-thickness central portion after the cold working.

3. The hot-rolled steel sheet according to claim 1,
wherein Vickers hardness of a sheet-thickness central portion when cold working that makes a work hardening rate of Vickers hardness less than 30% and thermal treatment of heating at 560 to 620° C. for 120 minutes are performed sequentially on the hot-rolled steel sheet exhibits resistance to softening of 80% or more with respect to Vickers hardness of the sheet-thickness central portion after the cold working.

4. A steel material comprising the hot-rolled steel sheet according to claim 1,
wherein Vickers hardness of a sheet-thickness central portion when cold working and thermal treatment of heating at 560 to 620° C. for 120 minutes are performed sequentially on the hot-rolled steel sheet is 80% or more with respect to Vickers hardness of the sheet-thickness central portion after the cold working.

5. The steel material according to claim 4,
wherein Vickers hardness of a sheet-thickness central portion when cold working that makes a work hardening rate of Vickers hardness less than 30% and thermal treatment of heating at 560 to 620° C. for 120 minutes are performed sequentially on the hot-rolled steel sheet is 80% or more with respect to Vickers hardness of the sheet-thickness central portion after the cold working.

6. A method for producing a hot-rolled steel sheet according to claim 1, the method comprising:
heating a slab to 1200° C. or more;
performing final rolling of finish rolling at a finish rolling temperature of equal to or more than 860° C. and equal to or less than 950° C.;
performing cooling at an average cooling rate of equal to or more than 30° C./sec and equal to or less than 100° C./sec from the finish rolling temperature to 800° C.;
performing cooling at an average cooling rate of equal to or more than 5° C./sec and equal to or less than 100° C./sec from 800° C. to a coiling temperature; and
performing coiling at a coiling temperature of equal to or more than 300° C. and equal to or less than 600° C.,
wherein the slab consists of chemical components of, in mass %,
C: 0.040 to 0.150%,
Si: 0 to 0.08%,
Mn: 0.10 to 1.50%,
P: 0 to 0.050%,
S: 0 to 0.020%,
Al: 0.010 to 0.050%, N: 0.0010 to 0.0060%,
Nb: 0.008 to 0.035%,
Cu: 0 to 0.10%,
Ni: 0 to 0.10%,
Cr: 0 to 0.02%,
Mo: 0 to 0.020%,
V: 0 to 0.020%,
Ca: 0 to 0.0100%,
B: 0 to 0.0050%, and
the balance: Fe and impurities.

7. The hot-rolled steel sheet according to claim 1, wherein the average crystal grain size of ferrite is equal to or more than 8 μm and equal to or less than 20 μm.

* * * * *